US005438708A

United States Patent [19]

Jacovitz

[11] Patent Number: 5,438,708

[45] Date of Patent: Aug. 8, 1995

[54] MANUAL WASTE COLLECTION, CONTAINMENT, AND DISPOSAL DEVICE

[76] Inventor: Jay S. Jacovitz, 4 Boxwood Rd., Norwalk, Conn. 06851-1105

[21] Appl. No.: 170,373

[22] Filed: Dec. 20, 1993

[51] Int. Cl.[6] ..... A41D 19/00

[52] U.S. Cl. ..... 2/161.6; 2/159; 2/160; 15/227

[58] Field of Search ..... 2/159, 160, 161.6, 161.7, 2/161.8, 167, 16; 294/1.3; 15/104.94, 227

[56] References Cited

U.S. PATENT DOCUMENTS

| | | | |
|---|---|---|---|
| 4,515,841 | 5/1985 | Dyke . | |
| 4,645,251 | 2/1987 | Jacobs . | |
| 4,677,697 | 7/1987 | Hayes . | |
| 4,741,565 | 5/1988 | Bagg . | |
| 4,768,818 | 9/1988 | Kolic . | |
| 4,788,733 | 12/1988 | Lerner . | |
| 4,845,781 | 7/1989 | Strickland et al. | 2/161.6 |
| 4,893,372 | 1/1990 | Wenzel | 2/16 |
| 4,902,283 | 2/1990 | Rojko et al. . | |
| 4,937,881 | 7/1990 | Heise . | |
| 4,964,188 | 10/1990 | Olson . | |
| 5,149,159 | 9/1992 | Bardes . | |
| 5,186,322 | 2/1993 | Harreld et al. | 2/159 |
| 5,222,772 | 6/1993 | Clonch . | |
| 5,301,806 | 4/1994 | Olson | 2/159 |

FOREIGN PATENT DOCUMENTS

| | | | |
|---|---|---|---|
| 2260889 | 5/1993 | United Kingdom | 2/160 |
| 91/003954 | 4/1991 | WIPO | 2/16 |

*Primary Examiner*—Clifford D. Crowder
*Assistant Examiner*—Gloria Hale
*Attorney, Agent, or Firm*—Ruden, Barnett, McClosky, Smith, Schuster & Russell

[57] ABSTRACT

The invention relates to a device for manually collecting, containing and disposing of waste material, such as animal excrement. The device of the present invention provides an ambidextrous glove having individual compartments for receiving the fingers and thumb of the hand. The glove has a sleeve portion with a pair of handles which are used to secure the sleeve portion on the forearm of the user. The handles are also used for turning the glove inside out to contain the collected material, and for sealing the device. The glove is provided with an absorbent, non-absorbent or abrasive contact means on the palm portion for contacting and removing the material to be collected from the surface upon which it is found.

19 Claims, 3 Drawing Sheets

MANUAL WASTE COLLECTION, CONTAINMENT, AND DISPOSAL DEVICE

FIELD OF THE INVENTION

This invention relates to a device for manually collecting, containing and disposing of waste material. More particularly, the present invention relates to a device which makes use of the movement capabilities of a person's palm and fingers to collect material, while avoiding contact between the material to be collected and the user's skin or clothing. The device according to the present invention is inverted to become a container for the collected material, which may be easily disposed.

BACKGROUND OF THE INVENTION

In the past, the problem of picking up and disposing of material, such as animal litter, has involved the use of several devices which are not practical to make or use. Long rods terminating in rectangular metal or plastic scoops have been used to collect animal waste. Such scoops are difficult to maneuver, as well as heavy and cumbersome to carry. Moreover, in order to be stored and reused, metallic scoops must be washed and dried to minimize rusting.

Other devices for disposing of animal litter involve the attachment of bags to frames having "scissor-like" hinging and metallic or plastic members for pushing the waste into the bags. Such devices are also cumbersome to carry and handle. In order to be reused, the bags must be reattached to the frames.

Other waste disposal methods involve the use of disposable plastic bags having wire frames which encircle the bag's open end. Waste material must be pushed into the bag and the wire frame must be manually pressed in order to seal the bag. The manipulation required with such methods often results in soiling of the user's hands.

Glove-like systems which may be inverted or turned inside-out for waste disposal have been utilized in the past. However, such systems have numerous disadvantages and shortcomings. For example, the glove of U.S. Pat. No. 4,645,251 is "mitten" shaped, having an enlarged portion for receiving the user's four fingers. Such a design makes it difficult for the user to feel and grasp the object to be picked up. Moreover, the system requires the use of more than one glove. A flexible inner glove is placed over the hand of a user. A flexible outer glove is placed over the inner glove. After picking up of waste, the outer glove is removed or stripped off of the inner glove to an inside-out pouch forming configuration. The outer glove must be grasped by the sleeve in order to be pealed off. In doing so, the user's ungloved hand may become soiled.

Similarly, U.S. Pat. No. 4,788,733 to Lerner discloses a glove having a towel layer. However, individual compartments for accommodating each of the user's fingers are not provided. Moreover, a user of the glove disclosed in U.S. Pat. No. 4,788,733 must grasp the free end of the glove's body with his/her ungloved hand in order to invert same. A relatively thin string surrounds the access opening of said glove to function as a tie. The string cannot be easily manipulated to cause inversion of the glove.

U.S. Pat. No. 5,222,777 to Clonch discloses an apparatus for picking up and removing objects, which involves the manipulation of a rigid. accordion-like compartment. The compartment is manipulated by exerting the force of the user's thumb on its top portion and the force of the user's other four digits on its bottom portion. Hence, the device of U.S. Pat. No. 5,222,777 cannot be effectively used for adequately cleaning irregular surfaces, or for containment of liquid waste. Moreover, the string which is circumscribingly attached to the device's open end does not facilitate removal of the device from the user's hand.

Glove-like collection systems of the past, having towel layers or other waste contact means, have not easily permitted a user to move and control his/her fingers and palm in order to grasp material to be collected. Moreover, the waste collection devices heretofore used have not provided a suitable means for covering the user's forearm in order to prevent soiling of the user's skin or clothing while the glove is being used. Although ties or strings have been provided on such glove-like devices, the ties or strings are difficult to attach to the device, and are cumbersome to operate. Moreover, such ties and strings are difficult to manipulate in order to cause inversion of glove-like devices.

SUMMARY OF THE INVENTION

The present invention solves the foregoing problems encountered in the manual collection, containment and disposal of waste materials.

It is an objective of the present invention to allow easy and comfortable movement of a person's fingers and thumb in collecting and wiping material from smooth or irregular surfaces. It is also an objective of the present invention to provide a glove device which protects the user's hand and forearm, and which may remain securely in place over the forearm while the device is in use. Another objective of the present invention is to permit the glove device to be quickly and easily removed without causing the user to soil his ungloved hand or clothing with the collected material.

The glove device of the present invention can be easily used to collect and dispose of solid or liquid waste without leakage of the material to be contained and without soiling the user's skin and/or clothing. The device of the present invention takes advantage of the movement capability of the user's fingers and thumb for grasping and removing material to be collected from the surface upon which it is found. Moreover, the device according to the present invention provides handles which may be easily manipulated to secure the device on the user's forearm and to invert and close the device.

Waste collection and containment according to the present invention is accomplished by providing a moisture-proof, vapor-proof glove with individual compartments for receiving the user's fingers and thumb. Because the compartments for fitting either the user's thumb or little finger are of the same size, the glove is ambidextrous in that it may suitably cover a right or left hand.

The glove has a sleeve portion extending up the user's forearm for protection of the user's skin and clothing. The sleeve portion of the glove is provided with a pair of handles which may be grasped by the user's free hand and pulled to turn the glove inside out. Once the glove is completely inverted, it becomes a bag-like container holding the waste. The handles may then be tied together, as in a knot, to seal the inverted device containing the waste material. The handles may also be looped or tied about the user's forearm to securely hold the sleeve portion in place on the user's arm while it is used to collect waste.

A pad for contacting the material to be collected and contained is positioned on the palm portion of the glove. The contact pad may be absorbent or non-absorbent flexible material which may be manipulated by the movement of the user's fingers and thumb in a clawing fashion to scoop up liquid or solid waste material. The contact pad may also be abrasive material, such as sandpaper, which may be manipulated by movement of the user's fingers and thumb to scrape solid waste material from surfaces to which such waste has adhered.

These and other objects and advantages of the present invention, will become apparent from the drawings, description of the invention and the claims which follow.

DESCRIPTION OF THE INVENTION

Figure 1:
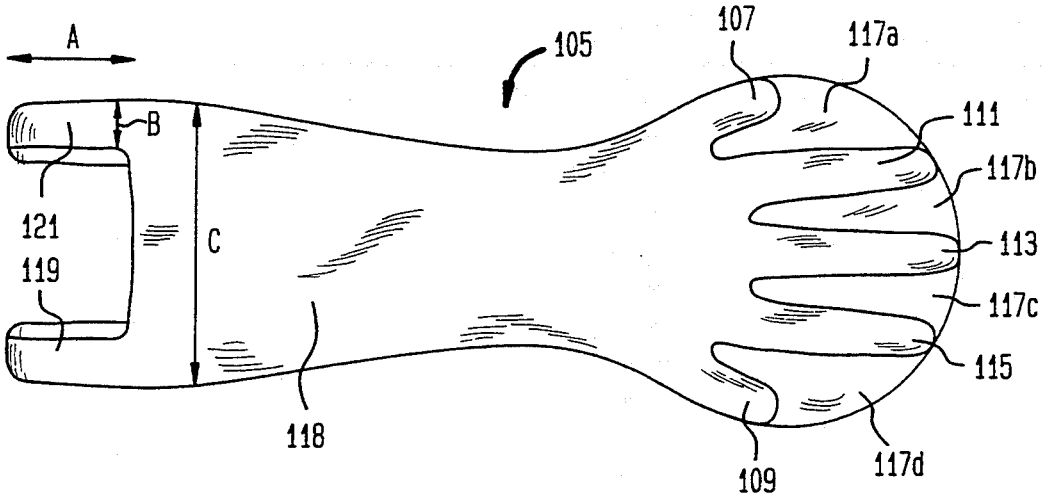
FIG. 1 is a plan view of the device of the present invention.

Referring to the drawings, particularly FIG. 1, there is shown the glove device of the present invention, represented by reference number 105. Glove device 105 is made of a flexible, moisture-proof and vapor-proof material. As used herein, the term "moisture-proof" shall mean substantially impervious to liquids or viscous fluids. Hence, glove 105 provides an effective barrier against the seepage of wetness or dampness. As used herein, "vapor-proof" shall mean substantially impervious to substances in the gaseous state. Accordingly, glove device 105 does not permit the penetration of harmful or toxic liquids or fumes. Moreover, after glove device 105 is inverted or turned inside-out to act as a container, as will be described in detail hereinbelow, unpleasant odors and liquid waste will not be released therefrom.

More particularly, glove device 105 may be made of polymerized thermoplastic materials, such as polyvinyl chloride, polyethylene terephthalate, and preferably polyethylene or polypropylene. Glove 105 may also be made of paper, such as recycled paper, or other flexible materials, provided that they are moisture-proof and vapor-proof, as defined hereinabove. Glove 105 is preferably opaque so that once contained, the waste will not be visible. If glove 105 is to be used for disposal of hazardous chemicals or radioactive materials, it is made of material, which will not permit penetration or seepage of the harmful substance, such as natural or synthetic rubber or metal-coated cloth or paper.

Glove device 105 has two compartments of the same size, represented by reference numbers 107 and 109, respectively, for receiving either the thumb or the little finger of the user's hand. Hence, glove 105 provides an ambidextrous fit suitable for receiving the fingers of a left or right human hand. Compartments, represented by reference numbers 111, 113 and 115, respectively, are sized to receive the middle three fingers of a human hand. The compartments are sized to fit the fingers and thumb loosely, rather than snugly, so as to provide comfort for the user and to permit glove 105 to be easily removed from the hand.

Figure 2:
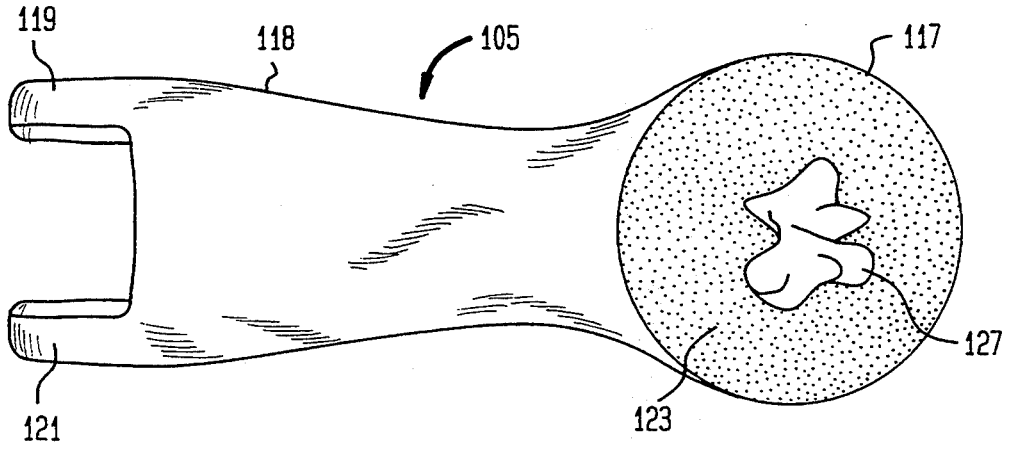
FIG. 2 is a plan view of the device of FIG. 1 showing the palm portion.

Reference numbers 117(*a*), 117(*b*), 117(*c*) and 117(*d*) represent the portions of a contact means spanning digit compartments 109, 115, 113, 111, and 107. As used herein, "contact means" is intended to mean a pliable layer or pad for contacting the material to be collected. It should be noted that the palm side view of the contact pad is shown in FIG. 2 and a more detailed description of the contact pad is included in the description of FIG. 2. Returning back to FIG. 1, glove device 105 creates a "webbed hand" appearance or effect which provides greater surface area for contacting the material to be collected than the mere uncovered palm of a user's hand. The webbed-hand effect provides better absorption and containment, as well as ease of collection by preventing waste material from falling in between the user's fingers.

Glove device 105 has a sleeve portion 118 which is suitable for substantially completely covering the wrist and forearm of the user. Hence, sleeve portion 118 typically terminates at the user's elbow. Sleeve portion 118 has a pair of handles 119 and 121 positioned thereon. Preferably, handle 119 is positioned directly opposite handle 121. As depicted in FIG. 1., handle 121 is located on the same side of thumb or little finger compartment 107 and handle 119 is located on the same side of thumb or little finger compartment 109. Handles 119 and 121 are preferably integral with glove device 105. As used herein, the term "integral" is intended to mean formed continuously with and of the same material as the glove. Hence, fastening means are not necessary for attaching the handles to the glove. However, if desired, fastening means may be used.

Handles 119 and 121 are of a size and shape suitable for encircling the user's ungloved hand and for being tied together. Hence, handles 119 and 121 are preferably generally rectangular in configuration, as shown in FIG. 1. The length of the rectangle being represented by line A in FIG. 1 and the width of the rectangle being represented by line B in FIG. 1. The length of the handle represented by line A should be as large or larger than the width of the user's palm. The width of the handle represented by line B should be sufficient to permit the user to grasp or grab the handle without slippage. Preferably, the dimension of line A ranges from 15 cm to 20 cm and the dimension of line B ranges from 8 cm to 10 cm.

The width of sleeve portion 118, represented by line C in FIG. 1, should be sufficient to permit the sleeve to fit loosely on the forearm. The glove device may be made in different sizes so that a loose fit may be achieved on user's of different sizes. It is important that sleeve portion 118 fit loosely so that handles 119 and 121 may be looped through each other or tied together to secure sleeve portion 118 on the forearm of the wearer, as described in more detail below in connection with a discussion of FIG. 5A and FIG. 5B. Preferably, the dimension of line C ranges from 30 cm to 38 cm.

FIG. 2 is a view of the glove device 105, showing the palm side of the user's hand. As used herein, "palm portion" is intended to mean the area which substantially covers the palm of the user's hand, as well as the user's fingers and thumb. Hence, referring to FIGS. 1 and 2, palm portion 123 comprises the circular area from the heel of the user's palm to the tips of the user's fingers and thumb.

The contact pad 117 is positioned on palm portion 123. The contact pad 117 should be of a size and shape suitable for covering the entire palm portion 123.

Contact pad 117 may be made of a pliable, absorbent material capable of absorbing liquids or viscous fluids. Suitable materials for the absorbent contact means are paper toweling, cloth, cellulose, foam rubber, wool, or materials containing thermoplastic filaments. Alternatively, contact pad 117 may be made of non-absorbent material such as waxed paper or metal foil. Contact pad 117 may also be an abrasive material suitable for grinding, polishing and/or removing solid material from regular or irregular surfaces, such as for example, sandpaper, scouring pad, steel wool, or a fabric coated with emery carborundum or other abrasive grit.

Contact pad 117 may be permanently positioned on glove device 105. As used herein, "permanently positioned" is intended to mean affixed or adhered in a permanent, stable position. Hence, contact pad 117 may be affixed or adhered through the use of organic or synthetic adhesives in order to permanently position the contact means on the glove. Such adhesives may be conveniently sprayed on in the process of making the device of the present invention. Moreover, when contact pad 117 contains thermoplastic filaments it may be heat sealed to the thermoplastic glove.

Figure 3:
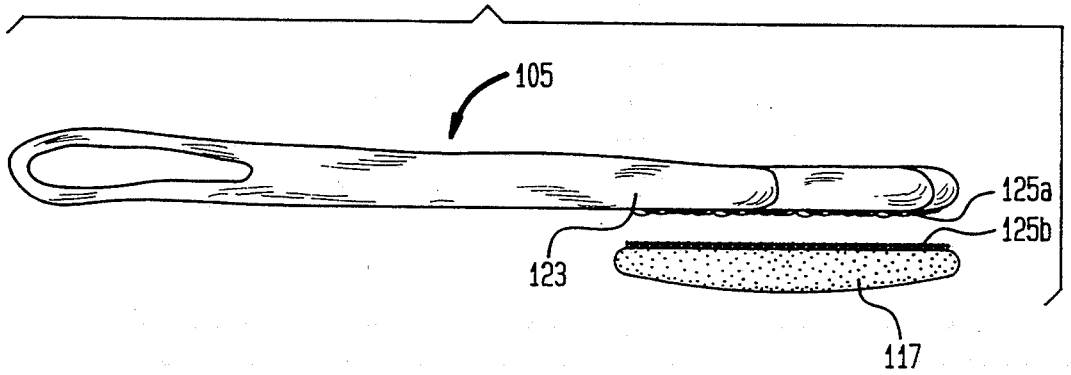
FIG. 3 is a side view of the device of FIG. 1.

Alternatively, contact pad 117 may be removably positioned on glove device 105. As used herein, "removably positioned" is intended to mean affixed in a stable position, which may be changed by lifting or removing the contact means from the palm portion. Hence, referring to FIG. 3, contact pad 117 may be removably positioned on glove device 105 by means of double-sided tape or mateable material, such as complementary hook and loop material, commonly known as VELCRO. Loop material **125*a* may be affixed or adhered on palm portion 123 by synthetic or organic adhesives. Complementary hook material 125*b* may also be affixed or adhered on contact pad 117 by means of synthetic or organic adhesives or by stitching. Similarly, hook material may be affixed on the palm portion 123 when loop material is affixed on the contact pad 117**. A removable contact means, such as that described hereinabove, is useful when one desires to use a variety of contact means in a clean-up job. For instance, it may be necessary to utilize an abrasive contact means for removing adhered waste and subsequently replace the abrasive contact means with an absorbent contact means which may be moistened for picking up the powdery waste material.

A user of glove device 105 manually grasps the material to be collected, which is represented by reference number 127. Material 127 may be animal waste such as feces and/or urine. Hence, the device of the present invention is useful in clean-ups involving pets, babies or incontinent human adults. In a laboratory setting, material 127 may be specimens, syringes, or materials impregnated with or containing hazardous chemicals. As stated hereinbefore, if glove 105 is to be used for collecting hazardous chemicals or materials, it is to be made of a material which will not permit penetration of such chemicals through glove device 105 and onto the skin or clothing of the user.

Paint, or viscous liquids, such as oils and stains, and objects having such liquids or oils may also be contained and disposed of with the device of the present invention. Hence, device 105 is useful for collecting and disposing of objects, such as used oil filters and paint brushes. Moreover, the device of the present invention may be used to apply paint or liquids to various surfaces, such as porous or irregular surfaces. In such use, the paint or liquid placed on absorbent contact pad 117, such as a foam contact pad. The contact pad so impregnated is then rubbed on the surface to be painted or moistened.

Depending upon the nature of the waste to be disposed, the glove and contact means may be made of either biodegradable or non-degradable materials. For instance, when the waste to be disposed of is hazardous, such as that encountered in laboratory or medical cleans-ups, it is preferred that the materials used to make the device of the present invention be non-degradable by microorganisms such as fungi or bacteria.

Figure 4:
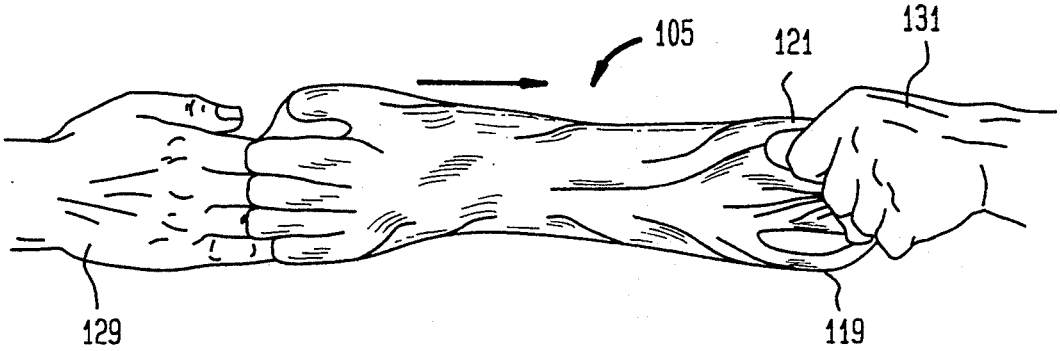
FIG. 4 is a plan view of the device of the present invention showing inversion by manipulation of the handles.

Referring now to FIG. 4, inversion of glove device 105 is shown. In order to invert glove device 105, the user grasps handles 119 and 121 with the user's ungloved hand 131 and pulls handles 119 and 121 away from the user's body, namely in the direction of the arrow shown in FIG. 4. Handles 119 and 121 may be grasped together with the user's ungloved hand at the start of the pulling movement in the direction of the arrow shown in FIG. 4. Alternatively, the user may begin to pull one handle before the other and may alternate in pulling handles 119 and 121, respectively, to accomplish complete inversion and removal of glove device 105. As stated hereinbefore, it is important that handles 119 and 121 be of a size and shape suitable for encircling the user's ungloved hand. Once glove device 105 is turned inside-out, the collected material 127 is contained therein. Because the finger compartments are of a size to fit loosely over the fingers, the user's hand 129 will withdraw before pulling the finger compartments completely off of the fingers.

Figure 5:
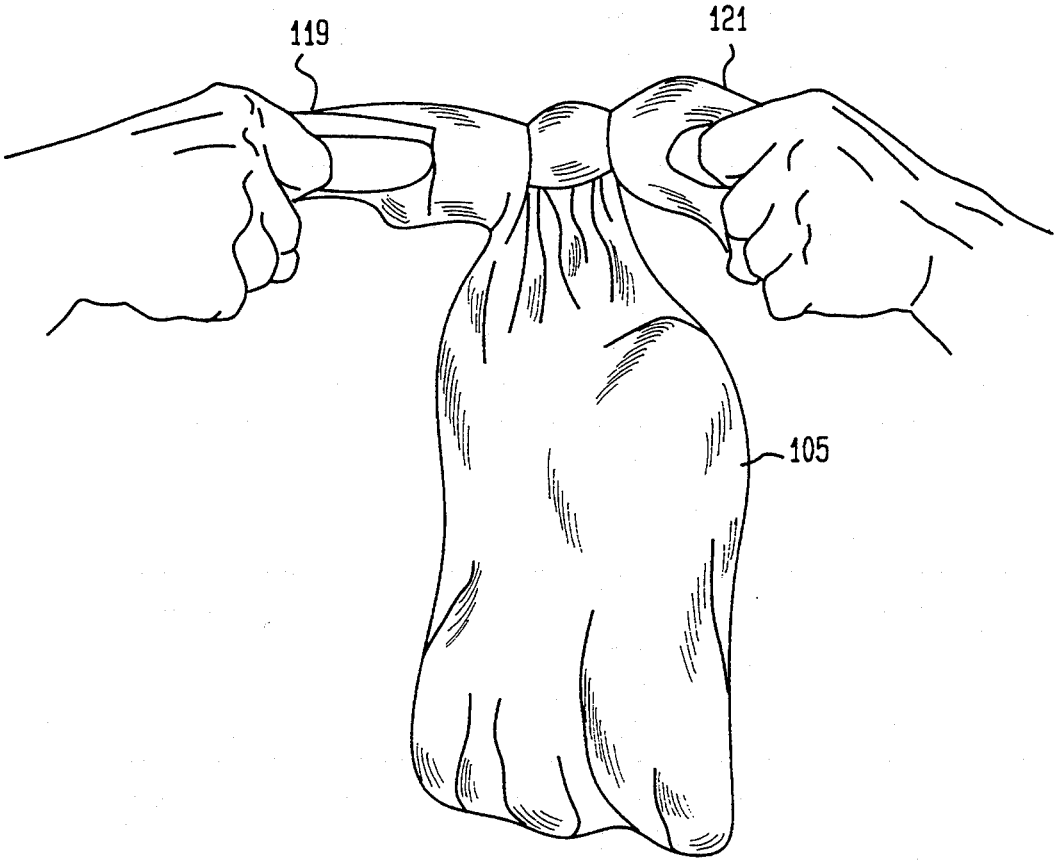
FIG. 5 is a plan view of the device of the present invention showing the handles being tied together to seal the device.

Referring to FIG. 5, there is shown closure of glove device 105. Handles 119 and 121 are joined together and drawn one or more times into a knot. The inverted and closed device 105 has the appearance of a round bottom bag with the finger compartments sharing the same area as the contained material. Because glove device 105 is preferably opaque, the waste contained therein will not be visible and, hence, is not pictured in FIG. 5. The inverted and closed device may be conveniently carried off for disposal.

Figure 6A:
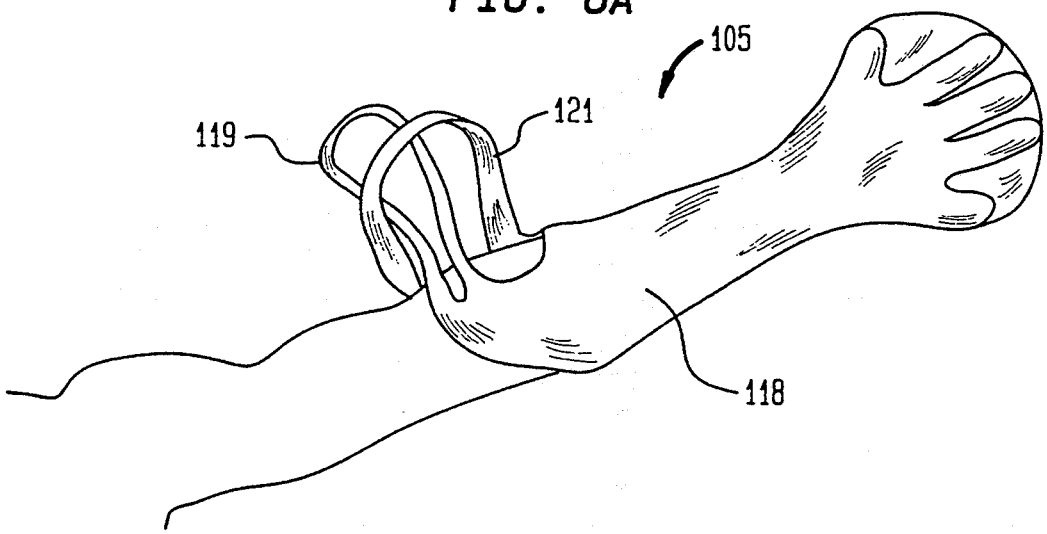
FIG. 6A and FIG. 6B are plan views of the device of the present invention showing the handles being looped about each other to secure the device to the user's forearm.
Figure 6B:
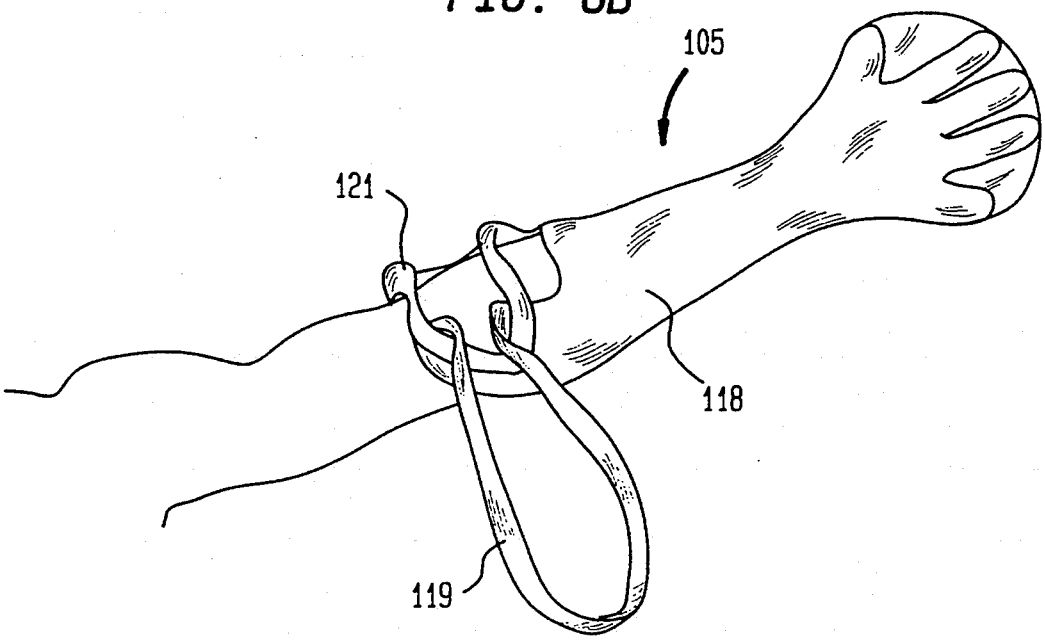

When the device of the present invention is to be used by the wearer for extended periods of time, other than for quick pick-up and immediate waste removal, the handles may serve as a means for securing the sleeve portion to the user's forearm. Referring now to FIG. 6A and FIG. 6B, handle 119 may be passed or looped through opposite handle 121 and then pulled back towards the user's body and downward. Upon accomplishing the foregoing, sleeve portion 118 is drawn tightly around the forearm and is resistant to slippage. Quick release is accomplished by unthreading handle 119 and handle 121. As noted above, sleeve portion 118 should be of a circumference large enough to permit the glove to fit loosely about the user's forearm. This permits handles 119 and 121 to be easily looped or tied to each other as described hereinabove.

The device of the present invention may be easily and inexpensively made by the use of traditional cutting or shaping tools to produce the glove of the desired form by pressure, such as die cutting. Moreover, when the glove is made of thermoplastic material it may be formed by heat and pressure such as heat sealing. Heat sealing may also be used to permanently position the contact pad on the glove when the contact pad has some thermoplastic content.

While the invention has been described in detail for the preferred forms shown, it will be understood that modifications may be made without departing from the spirit and scope of the invention and the appended claims.

What is claimed is:

1. A glove device for manually collecting and containing material, comprising:

(a) a palm portion suitable for substantially covering the palm of the user's hand, said palm portion including compartments to receive the fingers and thumb of either a left or right hand;

(b) a sleeve portion connected to said palm portion which is suitable for substantially completely covering the wrist and forearm of the user;

(c) contact means for contacting the material to be collected and contained, said contact means being positioned on said palm portion of the glove; and (d) a pair of handles positioned on said sleeve portion; said handles being of a length and width suitable for being looped through each other for attachment of the sleeve portion to the user's elbow and for encircling the user's ungloved hand to permit the user to invert the glove device by grasping and pulling said handles.

2. The glove device of claim 1 wherein the handles are integral with the glove.

3. The glove device of claim 1 wherein the handles are rectangular in shape having a length of between 15 cm and 20 cm and having a width of between 8 cm and 10 cm.

4. The glove device of claim 1 wherein the contact means is permanently positioned on said palm portion.

5. The glove device of claim 1 wherein the contact means is removably positioned on said palm portion.

6. The glove device of claim 5 wherein mateable material is located on the palm portion of the glove for removably positioning the contact means on the palm portion.

7. The glove device of claim 6 wherein the mateable material is complimentary hook and loop material.

8. The glove device of claim 1 wherein the contact means is a layer of absorbent material.

9. The glove device of claim 1 wherein the contact means is a layer of non-absorbent material.

10. The glove device of claim 1 wherein the contact means is a layer of abrasive material.

11. A device for manually collecting and containing material, comprising:

(a) a flexible, moisture-proof, vapor-proof glove for enclosing a hand, said glove having a palm portion suitable for substantially covering the palm of the user's hand and a sleeve portion suitable for substantially completely covering and loosely fitting the wrist and forearm of the user, said glove including three individual compartments for loosely fitting the middle three fingers of the user's hand and two individual compartments of equal size for loosely fitting the thumb or little finger of the user's hand;

(b) contact means, positioned on said palm portion, for contacting the material to be collected and contained, said contact means substantially covering the circular area comprising the heel of the user's palm to the tips of the palm side of the user's fingers and thumb and having four spaced portions of said contact means spanning the finger and thumb compartments to provide a webbed glove hand;

(c) a pair of handles positioned on said sleeve portion; said handles being located directly opposite each other and being of length and width suitable for being looped through each other for attachment of the sleeve portion to the user's elbow and for encircling the user's ungloved hand to permit the user to invert the glove device by grasping and pulling said handles.

12. The device of claim 11 wherein the contact means is permanently positioned on said palm portion.

13. The device of claim 11 wherein the contact means is removably positioned on said palm portion.

14. The device of claim 13 wherein mateable material is located on the contact means and on the palm portion of the glove for removably positioning said contact means on said palm portion.

15. The device of claim 14 wherein the mateable material is complimentary hook and loop material.

16. The device of claim 11 wherein the first handle is located on the side of the individual compartment for fitting the user's thumb and the second handle is located on the side of the individual compartment for fitting the user's little finger.

17. The device of claim 11 wherein the contact means is a layer of absorbent material.

18. The device of claim 11 wherein the contact means is a layer of non-absorbent material.

19. The device of claim 11 wherein the contact means is a layer of abrasive material.

* * * * *